US012012723B2

(12) United States Patent
Moriki et al.

(10) Patent No.: US 12,012,723 B2
(45) Date of Patent: Jun. 18, 2024

(54) WORK MACHINE

(71) Applicant: HITACHI CONSTRUCTION MACHINERY CO., LTD., Tokyo (JP)

(72) Inventors: Hidekazu Moriki, Tokyo (JP); Ryu Narikawa, Tokyo (JP); Masaki Kanai, Tokyo (JP); Kouji Shiwaku, Tsuchiura (JP); Shinya Imura, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 387 days.

(21) Appl. No.: 17/429,953

(22) PCT Filed: Dec. 13, 2019

(86) PCT No.: PCT/JP2019/049045
§ 371 (c)(1),
(2) Date: Aug. 11, 2021

(87) PCT Pub. No.: WO2020/194914
PCT Pub. Date: Oct. 1, 2020

(65) Prior Publication Data

US 2022/0136211 A1 May 5, 2022

(30) Foreign Application Priority Data

Mar. 26, 2019 (JP) ..... 2019-058540

(51) Int. Cl.
*E02F 9/20* (2006.01)
*E02F 3/43* (2006.01)
*E02F 9/24* (2006.01)

(52) U.S. Cl.
CPC ..... *E02F 9/2033* (2013.01); *E02F 9/24* (2013.01); *E02F 3/435* (2013.01)

(58) Field of Classification Search
None
See application file for complete search history.

(56) References Cited

U.S. PATENT DOCUMENTS 6,170,681 B1 * 1/2001 Yoshimatsu ..... B66C 23/905 212/278
6,275,757 B1 * 8/2001 Watanabe ..... E02F 9/2296 37/234

(Continued)

FOREIGN PATENT DOCUMENTS

CN 1128553 A * 8/1996 ..... E02F 3/435
CN 105518220 A * 4/2016 ..... E02F 3/32

(Continued)

OTHER PUBLICATIONS

English text of CN 1128553 (Year: 1996).*

(Continued)

*Primary Examiner* — Daniel L Greene
(74) *Attorney, Agent, or Firm* — MATTINGLY & MALUR, PC

(57) ABSTRACT

In a case that a change instruction to instruct to change a work area A1 to a requested work area A2 is input, whether or not change of the work area A1 to the requested work area A2 is possible is judged on the basis of the work area A1, location information of a machine main body configured by an upper swing structure 10 and a lower track structure 9, and posture information of a work device 15, and the work area A1 is overwritten with the requested work area A2 to change the work area in an only case that it is judged that change is possible. This can suppress interference between plural work machines.

4 Claims, 7 Drawing Sheets

(56) References Cited

U.S. PATENT DOCUMENTS

| | | | | |
|---|---|---|---|---|
| 2012/0136508 | A1 | 5/2012 | Taylor et al. | |
| 2012/0232763 | A1 | 9/2012 | Mizuochi et al. | |
| 2013/0066527 | A1* | 3/2013 | Mizuochi | E02F 9/24 701/50 |
| 2016/0251835 | A1* | 9/2016 | Kitajima | E02F 3/3663 701/50 |
| 2018/0066415 | A1* | 3/2018 | Friend | E02F 9/262 |
| 2018/0170369 | A1 | 6/2018 | Mitchell et al. | |

FOREIGN PATENT DOCUMENTS

| | | | | | |
|---|---|---|---|---|---|
| CN | 112584697 | A | * | 3/2021 | A01D 34/008 |
| JP | 2001-227001 | A | | 8/2001 | |
| JP | 2006-307436 | A | | 11/2006 | |
| JP | 2012-021290 | A | | 2/2012 | |
| WO | WO-0033152 | A1 | * | 6/2000 | E02F 3/842 |
| WO | 2011/049079 | A1 | | 4/2011 | |

OTHER PUBLICATIONS

English text of CN112584697 (Year: 2021).*
English text of CN 105518220 (Year: 2016).*
Extended European Search Report received in corresponding European Application No. 19921852.0 dated Oct. 11, 2022.
International Preliminary Report on Patentability received in corresponding International Application No. PCT/JP2019/049045 dated Oct. 7, 2021.
International Search Report of PCT/JP2019/049045 dated Mar. 3, 2020.

* cited by examiner

WORK MACHINE

CROSS-REFERENCE TO RELATED APPLICATION

This application is U.S. National Phase application under 35 U.S.C. § 371 of International Application No. PCT/JP2019/049045, filed Dec. 13, 2019, which claims the benefit of priority to Japanese Application No, JP2019-058540, filed on Mar. 26, 2019, the content of which is hereby incorporated by reference into this application.

TECHNICAL FIELD

The present invention relates to a work machine.

BACKGROUND ART

For example, a work machine such as a hydraulic excavator is required to be operated in such a manner that the work machine does not interfere with an environmental obstacle or the like in work. Thus, as a technique for supporting operation by an operator, a technique has been proposed in which an operation speed is automatically reduced to stop a work machine when the work machine has entered a range set in advance. For example, in Patent Document 1, a swing-system work machine is disclosed in which an upper swing structure is disposed on a lower track structure swingably around a vertical axis and a work attachment that can be displaced relative to the upper swing structure is disposed. The swing-system work machine includes present location sensing means for sensing a present location of the swing-system work machine, orientation sensing means for sensing an orientation of the upper swing structure, and displacement amount sensing means for sensing a displacement amount of the work attachment with respect to the upper swing structure. The swing-system work machine further includes storing means that stores three-dimensional obstacle coordinates made to correspond to obstacles such as buildings and facilities based on map data, work attachment position calculating means that calculates three-dimensional coordinates of a work attachment position from the sensed present location, the sensed orientation, and the sensed displacement amount of the work attachment with respect to the upper swing structure, and work attachment position coordinate determining means that determines whether or not the calculated work attachment position coordinates fall within an interference avoidance range set based on the stored obstacle coordinates. The swing-system work machine further includes movement velocity setting means for setting a movement velocity of the work attachment in a three-dimensional direction when the work attachment position coordinates fall within the interference avoidance range and control command output means that outputs a control command to a velocity control section of an actuator for swing of the upper swing structure and an actuator for the work attachment in such a manner that the movement velocity set by the movement velocity setting means is obtained.

PRIOR ART DOCUMENT

Patent Document

Patent Document 1: JP-2006-307436

SUMMARY OF THE INVENTION

Problem to be Solved by the Invention

However, in the above-described prior art, although consideration is made about prevention of interference with an environmental object when a single work machine operates, consideration needs to be further made about a case in which an environmental object that is a subject of prevention of interference moves, i.e., prevention of interference between plural work machines, because it is also quite likely that plural work machines simultaneously carry out work in a working site.

The present invention is made in view of the above description and intends to provide a work machine that can suppress interference between plural work machines.

Means for Solving the Problem

The present application includes plural means for solving the above-described problem. To cite one example thereof, a work machine includes a work device mounted on a machine main body, a plurality of actuators that drive the machine main body and the work device, a location information acquiring device that acquires location information that is information relating to a location of the machine main body, a posture information acquiring device that acquires posture information that is information relating to posture of the work device, and a controller configured to limit operation of at least one of the plurality of actuators on the basis of a work area that is an area in which movement of the machine main body and the work device is permitted, the location information acquired in the location information acquiring device, and the posture information acquired in the posture information acquiring device. The controller is configured to, in a case that a change instruction to instruct to change the work area to a requested work area is input, judge whether or not change of the work area to the requested work area is possible on the basis of the work area, the location information of the machine main body, and the posture information of the work device, and overwrite the work area with the requested work area to change the work area in an only case that it is judged that change is possible.

Advantages of the Invention

According to the present invention, interference between plural work machines can be suppressed.

MODE FOR CARRYING OUT THE INVENTION

Figure 1:
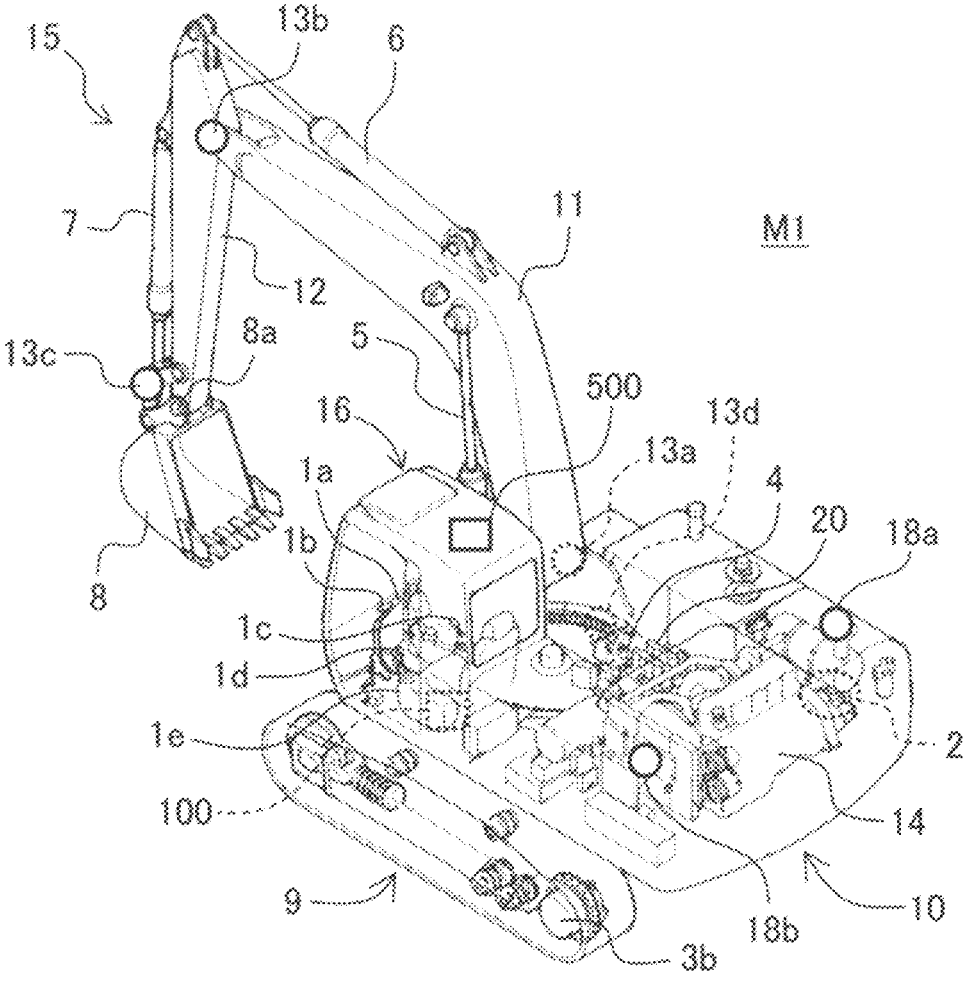
FIG. 1 is an appearance diagram schematically illustrating an appearance of a hydraulic excavator that is one example of a work machine according to the present embodiment.

One embodiment of the present invention will be described below with reference to FIG. 1 to FIG. 10.

In the present embodiment, as one example of a work machine, a hydraulic excavator including a work device (work implement) will be exemplified and described. However, the present invention can be applied also to, besides work machines such as a wheel loader, road machines such as a road roller, a crane, and so forth, for example.

Furthermore, in the following description, when plural elements exist as the same constituent element, alphabets are given to tail ends of reference characters (numbers) in some cases. However, these plural constituent elements are collectively represented with omission of these alphabets in some cases. For example, when four inertial measurement devices 13*a* to 13*d* exist, they may be collectively represented as inertial measurement devices 13.

FIG. 1 is an appearance diagram schematically illustrating an appearance of the hydraulic excavator that is one example of the work machine according to the present embodiment.

In FIG. 1, a hydraulic excavator M1 includes an articulated work device (a front work implement) 15 configured by linking plural driven members (a boom 11, an arm 12, and a bucket (work equipment) 8) that each pivot in a perpendicular direction, an upper swing structure 10, and a lower track structure 9 that configures a machine main body (hereinafter, simply referred to as a main body in some cases) of the hydraulic excavator M1 together with the upper swing structure 10. The upper swing structure 10 is disposed swingably relative to the lower track structure 9.

A base end of the boom 11 of the work device 15 is supported by a front part of the upper swing structure 10 pivotally in the perpendicular direction. One end of the arm 12 is supported by a tip of the boom 11 pivotally in the perpendicular direction. The bucket 8 is supported by another end of the arm 12, with the intermediary of a bucket link 8*a*, pivotally in the perpendicular direction.

The boom 11, the arm 12, the bucket 8, the upper swing structure 10, and the lower track structure 9 are driven by a boom cylinder 5, an arm cylinder 6, a bucket cylinder 7, a swing hydraulic motor 4, and left and right traveling hydraulic motors 3 (only a traveling hydraulic motor 3*b* on the left side is illustrated), respectively, that are hydraulic actuators. The traveling hydraulic motors 3 function as a movement device by driving each of a pair of left and right crawlers.

In a cab 16 in which an operator rides, a right operation lever device 1*c* and a left operation lever device 1*d* that output an operation signal for operating the hydraulic actuators 5 to 7 of the work device 15 and the swing hydraulic motor 4 of the upper swing structure 10, a right operation lever device 1*a* for traveling and a left operation lever device 1*b* for traveling that output an operation signal for operating the left and right traveling hydraulic motors 3 of the lower track structure 9, a gate lock lever 1*e*, and a controller 100 are disposed.

The operation lever devices 1*a*, 1*b*, 1*c*, and 1*d* are each an electrical operation lever device that outputs an electrical signal as the operation signal and each have an operation lever that is tilt-operated forward, rearward, leftward, and rightward by the operator and an electrical signal generating section that generates an electrical signal according to a tilt direction and a tilt amount (lever operation amount) of this operation lever. The electrical signal output from the operation lever devices 1*c* and 1*d* is input to the controller 100 through an electrical wiring line. In the present embodiment, operation of the operation lever of the right operation lever device 1*c* in a front-rear direction corresponds to operation of the boom cylinder 5, and operation of the same operation lever in a left-right direction corresponds to operation of the bucket cylinder 7. Meanwhile, operation of the operation lever of the left operation lever device 1*d* in the front-rear direction corresponds to operation of the swing hydraulic motor 4, and operation of the same operation lever in the left-right direction corresponds to operation of the arm cylinder 6.

Operation control of the boom cylinder 5, the arm cylinder 6, the bucket cylinder 7, the swing hydraulic motor 4, and the left and right traveling hydraulic motors 3 is carried out by controlling, by a control valve 20, a direction and a flow rate of a hydraulic operating fluid supplied to the hydraulic actuators 3 and 4 to 7 from a hydraulic pump device 2 driven by a prime mover such as an engine or an electric motor (in the present embodiment, an engine 14).

The control valve 20 is driven by a control signal output from the controller 100. The control signal is output from the controller 100 to the control valve 20 on the basis of operation of the right operation lever device 1*a* for traveling and the left operation lever device 1*b* for traveling, and operation of the left and right traveling hydraulic motors 3 of the lower track structure 9 is thereby controlled. Furthermore, the control signal is output from the controller 100 to the control valve 20 on the basis of the operation signal from the operation lever devices 1*c* and 1*d*, and operation of the hydraulic actuators 4 to 7 is thereby controlled. The boom 11 pivots in an upward-downward direction relative to the upper swing structure 10 by expansion and contraction of the boom cylinder 5. The arm 12 pivots in the upward-downward and front-rear directions relative to the boom 11 by expansion and contraction of the arm cylinder 6. The bucket 8 pivots in the upward-downward and front-rear directions relative to the arm 12 by expansion and contraction of the bucket cylinder 7.

A communication device 500 is disposed at an upper part of the cab 16 in which the operator rides. The communication device 500 doubles as an area change request receiving section and a work area transmitting section. The communication device 500 receives a requested work area (described later) and transmits whether or not change of the work area is possible and a present work area.

Inertial measurement devices (IMU: Inertial Measurement Unit) 13*a* to 13*d* as posture information acquiring devices for acquiring posture information are disposed for the vicinity of a linked part to the upper swing structure 10 in the boom 11, the vicinity of a linked part to the boom 11 in the arm 12, the bucket link 8*a*, and the upper swing structure 10, respectively. The inertial measurement device 13*a* is a posture information acquiring device (a boom posture sensor) that senses an angle of the boom 11 (a boom angle) with respect to a horizontal plane. The inertial measurement device 13*b* is a posture information acquiring device (an arm posture sensor) that senses an angle of the arm 12 (an arm angle) with respect to the horizontal plane. The inertial measurement device 13*c* is a posture information acquiring device (a bucket posture sensor) that senses an angle of the bucket link 8*a* with respect to the horizontal plane. Furthermore, the inertial measurement device 13*d* is a posture information acquiring device (a main body posture sensor) that senses an inclination angle (a roll angle, a pitch angle) of the upper swing structure 10 with respect to the horizontal plane.

The inertial measurement devices 13*a* to 13*d* are what measure an angular velocity and an acceleration. When a case is considered in which the upper swing structure 10 and the respective driven members 8, 11, and 12 for which the inertial measurement devices 13*a* to 13*d* are disposed remain still, the angles of the upper swing structure 10 and the respective driven members 8, 11, and 12 with respect to the horizontal plane can be sensed based on a direction of a gravitational acceleration (that is, a vertically downward direction) in an IMU coordinate system set in the respective inertial measurement devices 13*a* to 13*d* and attachment states of the respective inertial measurement devices 13*a* to 13*d* (that is, relative positional relations between the respective inertial measurement devices 13*a* to 13*d*, the upper swing structure 10, and the respective driven members 8, 11, and 12). Here, the inertial measurement devices 13*a* to 13*c* configure posture information acquiring devices that acquire posture information (angle signals) of each of the boom 11, the arm 12, and the bucket (work equipment) 8.

The present invention is not limited to the case in which an inertial measurement device (IMU) is used as the posture information acquiring device. For example, a configuration may be made in such a manner that posture information is acquired by using an inclination angle sensor. Moreover, potentiometers may be disposed for the linked parts of the respective driven members 8, 11, and 12, relative directions (posture information) of the upper swing structure 10 and the respective driven members 8, 11, and 12 may be sensed, and posture (angles with respect to the horizontal plane) of the respective driven members 8, 11, and 12 may be obtained from the sensing result. Furthermore, a configuration may be made in such a manner that a stroke sensor is disposed for each of the boom cylinder 5, the arm cylinder 6, and the bucket cylinder 7, and relative directions (posture information) at the respective connected parts of the upper swing structure 10 and the respective driven members 8, 11, and 12 are computed from stroke change amounts, and the posture (angles with respect to the horizontal plane) of the respective driven members 8, 11, and 12 is obtained from the result thereof.

In the upper swing structure 10, positioning devices 18*a* and 18*b* as location information acquiring devices that acquire location information that is information relating to a location of the machine main body are disposed. The positioning devices 18*a* and 18*b* are the GNSS (Global Navigation Satellite System), for example. The GNSS refers to a satellite positioning system by which signals from plural satellites are received to find a self-location on the globe. The positioning devices 18*a* and 18*b* are what receive signals (electric waves) from plural GNSS satellites (not illustrated) located above the globe and acquire locations of the positioning devices 18*a* and 18*b* in a terrestrial coordinate system by executing calculation on the basis of the obtained signals. Because the mounting positions of the positioning devices 18*a* and 18*b* with respect to the hydraulic excavator M1 are known in advance, the location and a direction (an orientation) of the hydraulic excavator M1 with respect to a reference point at a working site can be acquired as location information by acquiring the locations of the positioning devices 18*a* and 18*b* in the terrestrial coordinate system.

To the controller 100, the operation signal from the right operation lever device 1*a* for traveling, the left operation lever device 1*b* for traveling, the right operation lever device 1*c*, and the left operation lever device 1*d*, the main body location information from the positioning devices 18*a* and 18*b*, the posture information from the inertial measurement devices 13*a* to 13*d*, and the requested work area (described later) from the communication device 500 are input. The controller 100 outputs the control signal on the basis of these inputs to drive the control valve 20. In addition, the controller 100 outputs whether or not change of the work area is possible and the present work area to the communication device 500.

Figure 2:
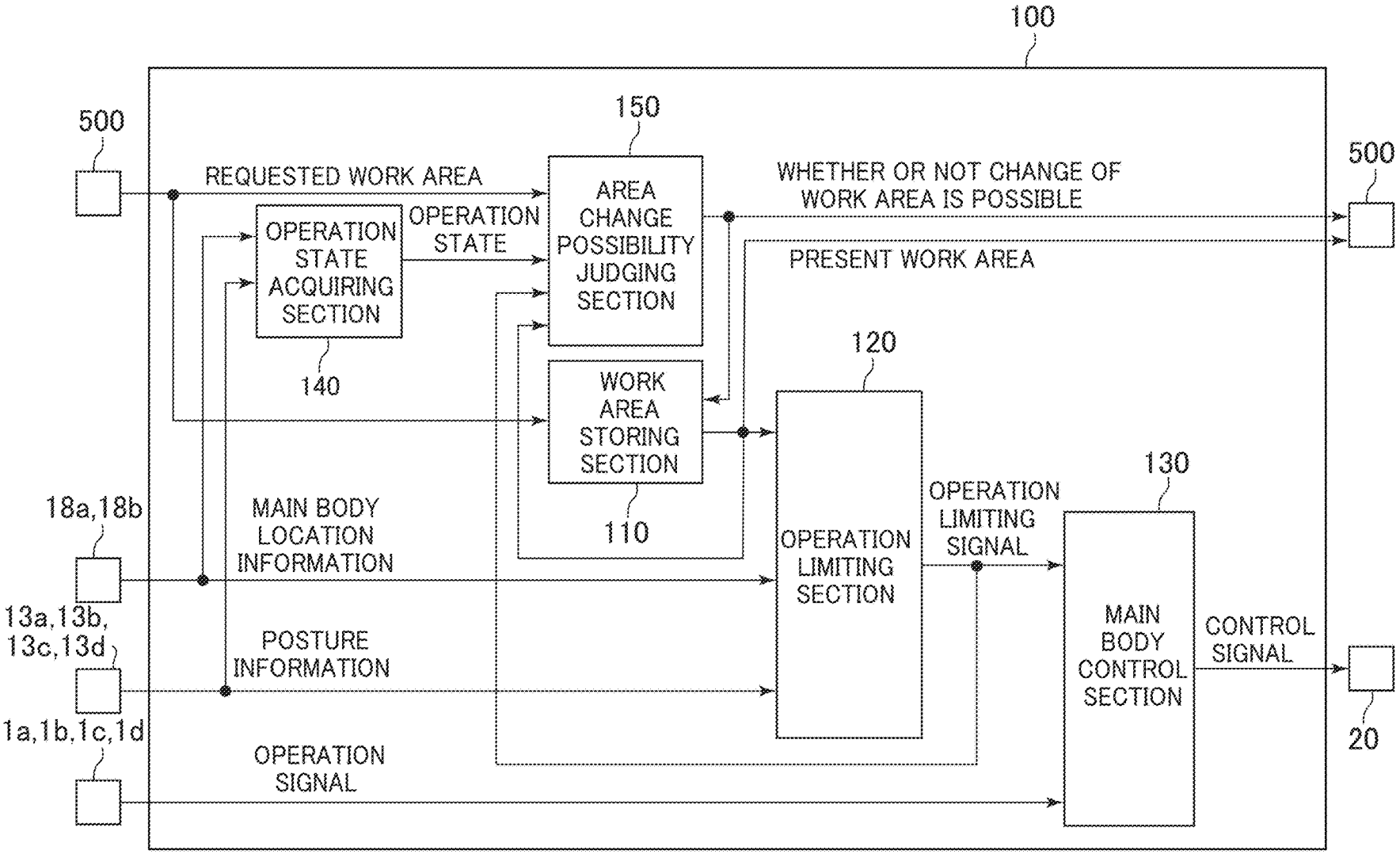
FIG. 2 is a functional block diagram illustrating processing functions of a controller.

FIG. 2 is a functional block diagram illustrating processing functions of the controller.

In FIG. 2, the controller 100 includes a work area storing section 110, an operation limiting section 120, a main body control section 130, an operation state acquiring section 140, and an area change possibility judging section 150.

According to the requested work area from the communication device 500 and whether or not change of the work area is possible from the area change possibility judging section 150, the work area storing section 110 changes the present work area to the requested work area when change of the work area is possible and outputs the work area to the operation limiting section 120 and the communication device 500. On the other hand, when change of the work area is not possible, the work area storing section 110 outputs the present work area to the operation limiting section 120 and the communication device 500 without changing it.

The operation limiting section 120 calculates an operation limiting signal according to the present work area from the work area storing section 110, the main body location information from the positioning devices 18*a* and 18*b*, and the posture information from the inertial measurement devices 13*a* to 13*d* and outputs the operation limiting signal to the main body control section 130 and the area change possibility judging section 150. Contents of the calculation of the operation limiting section 120 will be described in detail later.

The main body control section 130 calculates and outputs control signals on the basis of the operation signal from the right operation lever device 1*c* and the left operation lever device 1*d* and the operation limiting signal from the operation limiting section 120, and drives each directional control valve in the control valve 20 corresponding to a respective one of the signals. Contents of the calculation of the main body control section 130 will be described in detail later.

The operation state acquiring section 140 calculates an operation state of the hydraulic excavator M1 on the basis of the main body location information from the positioning devices 18*a* and 18*b* and the posture information from the inertial measurement devices 13*a* to 13*d* and outputs the operation state to the area change possibility judging section 150. Here, the operation state is a movement velocity of the hydraulic excavator, a swing velocity, and a movement velocity of the bucket.

The area change possibility judging section 150 receives, as inputs, the requested work area from the communication device 500, the operation state from the operation state acquiring section 140, the present work area from the work area storing section 110, and the operation limiting signal from the operation limiting section 120, calculates whether or not change of the work area is possible based on the inputs, and outputs whether or not change of the work area is possible to the work area storing section 110 and the communication device 500. Regarding the present work area and the operation limiting signal, values of the last cycle of calculation cycles of the controller 100 are used. Details of the calculation executed in the area change possibility judging section 150 will be described later.

Figure 3:
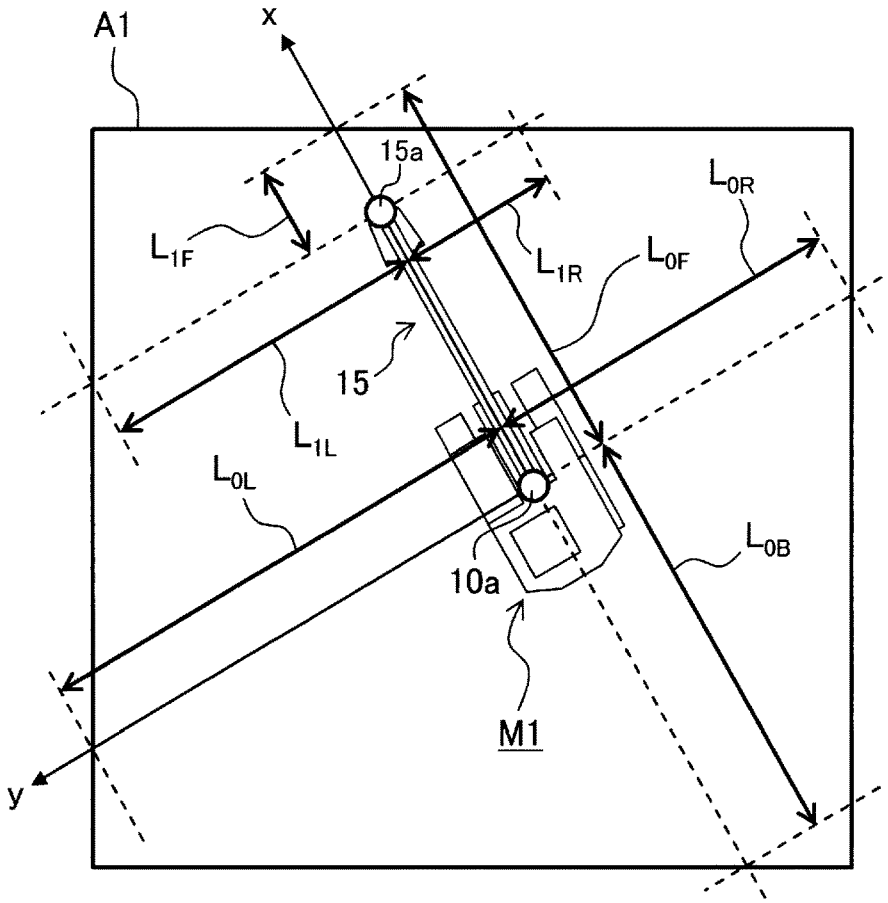
FIG. 3 is a diagram for explaining details of calculation processing of an operation limiting section.

FIG. 3 is a diagram for explaining details of calculation processing of the operation limiting section.

In FIG. 3, a state is illustrated in which the hydraulic excavator M1, which is a work machine, is disposed in a work area A1 set at a working site in advance as a range in which operation of the main body (the upper swing structure 10) of the hydraulic excavator M1 and the work device 15 is permitted. For the hydraulic excavator M1, a main body coordinate system having an x-axis along which a front side is defined as a positive side and a y-axis that is perpendicular to a swing axis and the x-axis and along which a left lateral side is defined as a positive side is set, with the center of swing being origin. Further, suppose that the work area A1 is set with a polygon in which all interior angles are smaller than 180 degrees.

The operation limiting section 120 calculates the operation limiting signal according to a distance between a boundary of the present work area A1 and the machine main body of the hydraulic excavator M1 or the work device 15. Specifically, first, at each of the center of swing of the hydraulic excavator M1 and a tip part of the work device 15 (a part at which a horizontal distance from the center of swing is the longest in the work device 15), a point that serves as the basis of calculation (hereinafter, referred to as reference points 10*a* and 15*a*) is set.

Then, regarding the reference point 10*a* of the machine main body, a distance L0R from the reference point 10*a* to the boundary of the work area A1 in the right direction along the y-axis, a distance L0L from the reference point 10*a* to the boundary of the work area A1 in the left direction along the y-axis, a distance L0F from the reference point 10*a* to the boundary of the work area A1 in the front direction along the x-axis, and a distance L0B from the reference point 10*a* to the boundary of the work area A1 in the rear direction along the x-axis are each computed. Further, the operation limiting signal is calculated in such a manner that the movement velocity of the hydraulic excavator M1 in the front direction, the rear direction, the right direction, and the left direction is limited according to the distances L0F, L0B, L0R, and L0L.

Similarly, regarding the reference point 15*a* of the work device 15, a distance L1R from the reference point 15*a* to the boundary of the work area A1 in the right direction along the y-axis, a distance L1L from the reference point 15*a* to the boundary of the work area A1 in the left direction along the y-axis, and a distance L1F from the reference point 15*a* to the boundary of the work area A1 in the front direction along the x-axis are each computed. Then, the operation limiting signal is calculated in such a manner that the velocity in an extension direction and the swing velocity in the left-right direction regarding the work device 15 are limited according to the distances L1F, L1R, and L1L.

Figure 4:
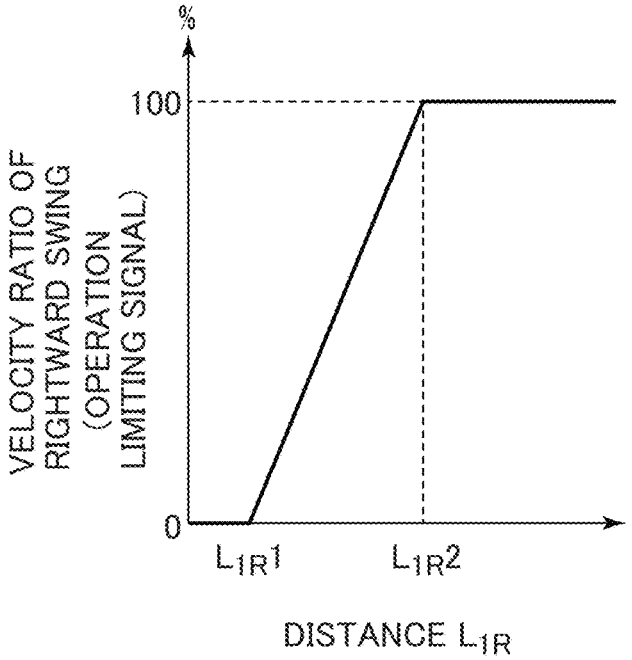
FIG. 4 is a diagram illustrating one example of a computation map for computing an operation limiting signal.

FIG. 4 is a diagram illustrating one example of a computation map for computing the operation limiting signal.

In FIG. 4, one example of the computation map of the operation limiting signal with respect to the distance L1R to the boundary of the work area A1 in the right direction along the y-axis direction from the reference point 15*a* of the work device 15 is illustrated as a representative. Specifically, as illustrated in FIG. 4, when the distance L1R satisfies 0 (zero)≤L1R≤L1R1, the operation limiting section 120 generates the operation limiting signal that causes a velocity ratio of rightward swing to be 0 (zero) %. When the distance L1R satisfies L1R1<L1R<L1R2, the operation limiting section 120 generates the operation limiting signal that causes the velocity ratio of rightward swing to become higher toward 100% as L1R becomes larger. When the distance L1R satisfies L1R2 L1R, the operation limiting section 120 generates and outputs the operation limiting signal that causes the velocity ratio of rightward swing to be 100%.

Also regarding the other distances L1F, L1L, L0F, L0B, L0R, and L0L, similarly the operation limiting section 120 calculates the velocity ratio of the corresponding hydraulic actuator and outputs the velocity ratio as the operation limiting signal.

Figure 5:
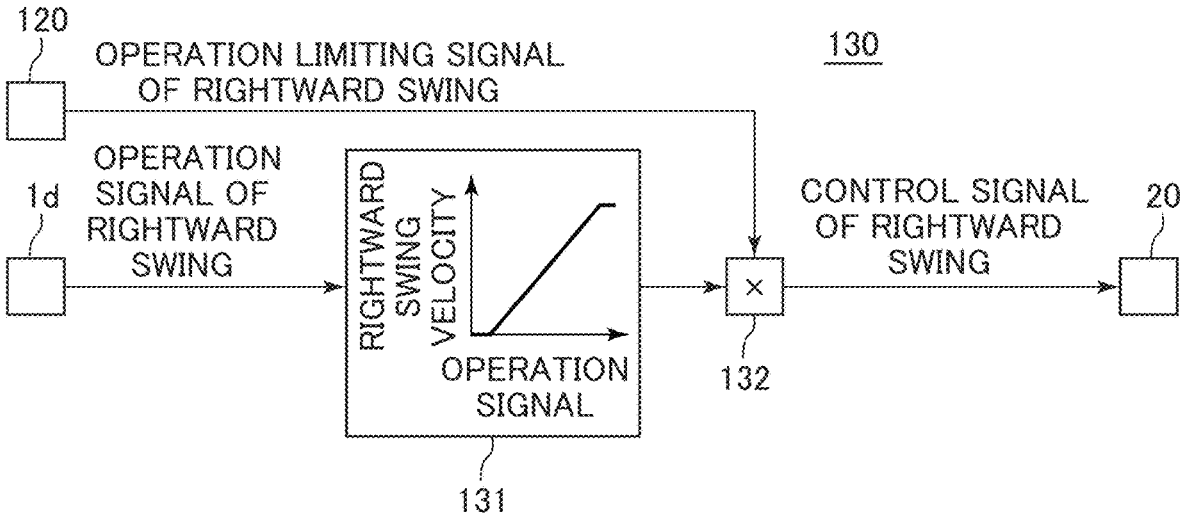
FIG. 5 is a functional block diagram illustrating one example of calculation processing of a main body control section.

FIG. 5 is a functional block diagram illustrating one example of calculation processing of the main body control section.

In FIG. 5, one example of calculation of the control signal relating to rightward swing is illustrated as a representative. Specifically, as illustrated in FIG. 5, the main body control section 130 calculates the rightward swing velocity according to the operation signal of rightward swing from the operation lever device 1*d* (that is, rightward swing velocity requested based on the operation amount of the operation lever device 1*d*) by using a map 131 for calculation defined in advance. Then, the main body control section 130 multiples the calculated rightward swing velocity by the operation limiting signal of rightward swing by using an operator 132 and outputs the multiplication result to the control valve 20 as the control signal of rightward swing. The map 131 is set in advance in such a manner that the rightward swing velocity becomes higher as the operation signal of rightward swing becomes larger. Further, as illustrated in FIG. 4, the operation limiting signal of rightward swing is the velocity ratio of rightward swing, and the control signal of rightward swing is calculated in such a manner that the rightward swing velocity becomes lower as the velocity ratio (the operation limiting signal) of rightward swing becomes lower.

Figure 6:
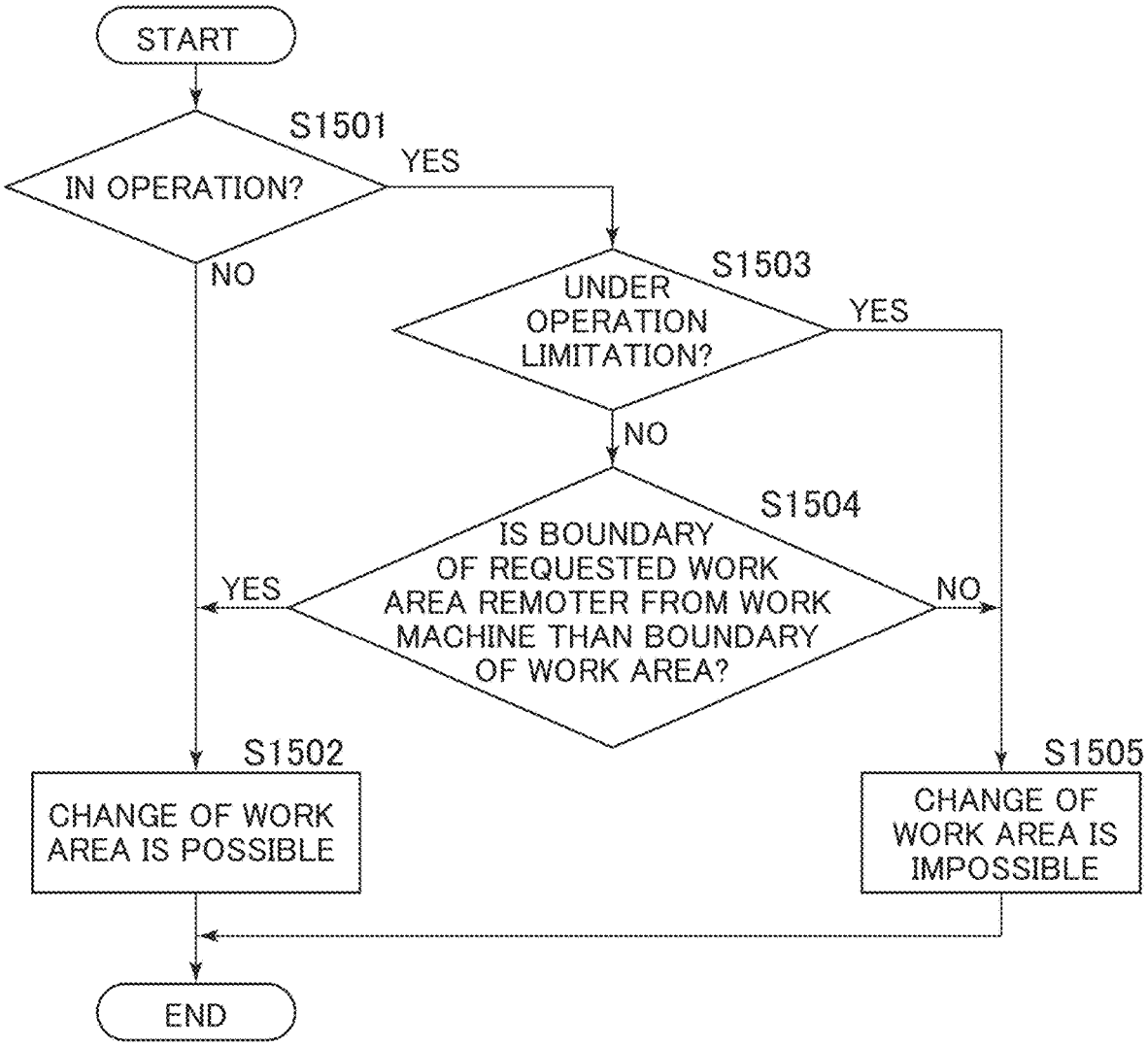
FIG. 6 is a flowchart illustrating contents of processing of an area change possibility judging section.

FIG. 6 is a flowchart illustrating contents of processing of the area change possibility judging section.

In FIG. 6, first, the area change possibility judging section 150 of the controller 100 determines whether the hydraulic excavator M1 is operating based on the operation state acquired in the operation state acquiring section 140 (step S1501). When the determination result is NO, the area change possibility judging section 150 judges that change of the work area A1 is possible (step S1502), and ends the processing. In the present embodiment, the case has been exemplified and described in which the movement velocity, the swing velocity, and the movement velocity of the bucket are acquired as the operation state and it is determined that the hydraulic excavator M1 is operating when the movement velocity is higher than a value set in advance (for example, when the movement velocity is higher than 0 (zero)). However, for example, a configuration may be adopted in such a manner that a position of the gate lock lever 1*e* is used as operation information and it is determined that the hydraulic excavator M1 is operating when the gate lock lever 1*e* is in a lowered state, i.e., when operation of the operation lever device 1*d* and so forth by the operator is valid.

Moreover, when the determination result in the step S1501 is YES, that is, when the area change possibility judging section 150 determines that the hydraulic excavator M1 is operating, subsequently the area change possibility judging section 150 determines whether the hydraulic excavator M1 is under operation limitation (for example, whether the operation limiting signal is lower than 95%) from the operation limiting signal of the operation limiting section 120 (step S1503). When the determination result is YES, the area change possibility judging section 150 judges that change of the work area A1 is impossible (step S1505), and ends the processing.

Further, when the determination result in the step S1503 is NO, that is, when the area change possibility judging section 150 determines that the hydraulic excavator M1 is not under operation limitation, subsequently the area change possibility judging section 150 determines whether a boundary of a requested work area is remoter from the work machine (the reference point 10*a* and the reference point 15*a*) than the boundary of the work area (step S1504). When the determination result is YES, the area change possibility judging section 150 determines that change of the work area is possible (step S1502), and ends the processing. When the determination result is NO, the area change possibility judging section 150 determines that change of the work area is impossible (step S1505), and ends the processing.

In the step S1504, regarding all sides different from the work area A1 in the respective sides of the polygon that forms the requested work area, whether the distance thereof from the work machine (the reference point 10*a* and the reference point 15*a*) is longer than the boundary of the work area is determined. Furthermore, in the step S1504, when the requested work area is closer in even one side regarding the sides of the determination target (that is, when even one side closer than the respective sides that form the boundary of the work area exists in the respective sides that form the boundary of the requested work area), the area change possibility judging section 150 makes NO as the determination result and proceeds to the step S1505 to judge that change of the work area is impossible. Only when the requested work area is remoter than the work area regarding all sides of the determination target, the area change possibility judging section 150 makes YES as the determination result and proceeds to the step S1502 to judge that change of the work area is possible.

Figure 7:
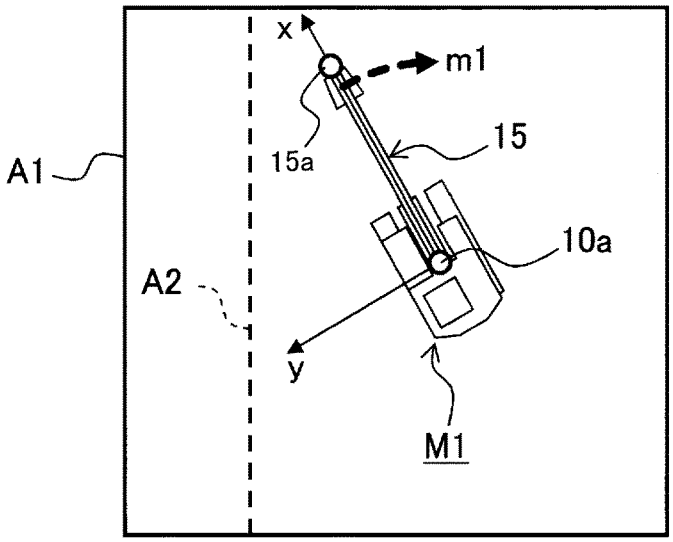
FIG. 7 is a diagram for specifically explaining the contents of the processing in the area change possibility judging section.
Figure 8:
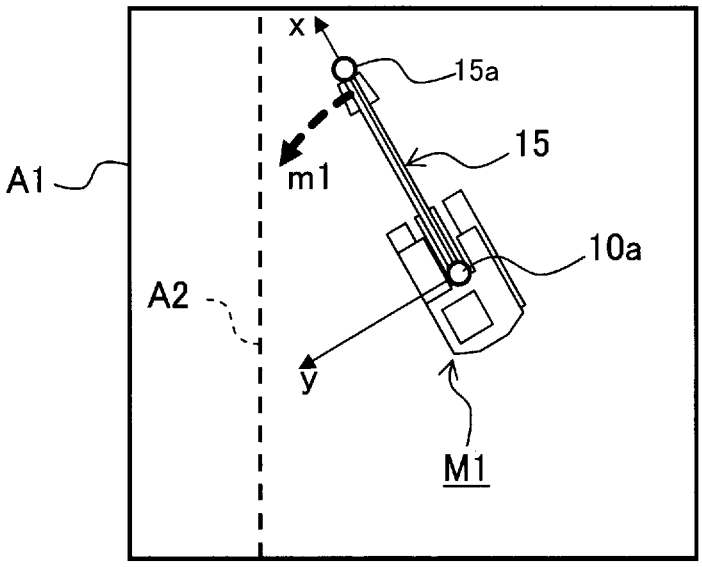
FIG. 8 is a diagram for specifically explaining the contents of the processing in the area change possibility judging section.
Figure 9:
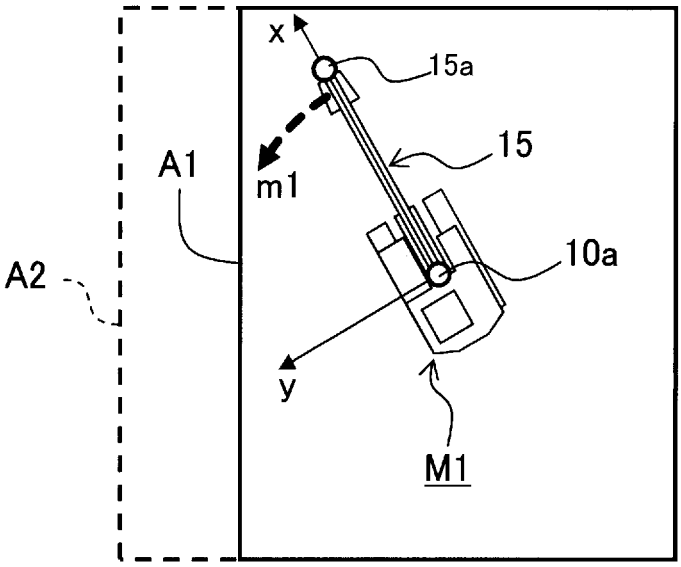
FIG. 9 is a diagram for specifically explaining the contents of the processing in the area change possibility judging section.

FIG. 7 to FIG. 9 are diagrams for specifically explaining the contents of the processing in the area change possibility judging section and are diagrams that exemplify cases in which the relation between the requested work area and the work area and the operation state of the work machine are each changed. In FIG. 7 to FIG. 9, cases in which the hydraulic excavator M1 is disposed inside the work area A1 and a requested work area A2 and the hydraulic excavator M1 is moving (hare, cases in which the reference point 15*a* of the work device 15 is moving in a direction of a dotted line ml due to swing operation of the hydraulic excavator M1) are exemplified.

In FIG. 7, the hydraulic excavator M1 (specifically, the reference point 15*a* of the work device 15) is carrying out swing operation in such a direction as to get further away from the side of the boundary of the requested work area A2 different from the present work area A1. Suppose that the hydraulic excavator M1 is not under operation limitation.

In this case, in the processing of the area change possibility judging section 150, it is determined in the step S1501 in FIG. 6 that the hydraulic excavator M1 is in operation (YES) and it is determined in the step S1503 that the hydraulic excavator M1 is not under operation limitation (NO). Then, it is determined in the step S1504 that the boundary of the requested work area is narrowed relative to the present work area (NO), and it is judged that change of the work area is impossible (step S1505). Due to such processing, it is possible to prevent sudden deceleration or sudden stop of the operation of the hydraulic excavator M1 due to change of the work area A1, i.e., sudden change in the operation of the hydraulic excavator M1 due to sudden satisfaction of the condition of the operation limitation.

In FIG. 8, the hydraulic excavator M1 (specifically, the reference point 15*a* of the work device 15) is carrying out swing operation in such a direction as to get closer to the side of the boundary of the requested work area A2 different from the present work area A1.

In this case, in the processing of the area change possibility judging section 150, it is determined in the step S1501 in FIG. 6 that the hydraulic excavator M1 is in operation (YES). Then, when it is determined in the step S1503 that the hydraulic excavator M1 is under operation limitation (YES), it is judged that change of the work area is impossible (step S1505). Further, even when it is determined in the step S1503 that the hydraulic excavator M1 is not under operation limitation (NO), it is determined in the step S1504 that the boundary of the requested work area is narrowed relative to the present work area (NO) and it is judged that change of the work area is impossible (step S1505). This can prevent sudden deceleration or sudden stop of the operation of the hydraulic excavator M1 due to change of the work area A1, i.e., sudden change in the operation of the hydraulic excavator M1 due to sudden satisfaction of the condition of the operation limitation.

In FIG. 9, the hydraulic excavator M1 (specifically, the reference point 15*a* of the work device 15) is carrying out swing operation in such a direction as to get closer to the side of the boundary of the requested work area A2 different from the present work area A1. Suppose that the hydraulic excavator M1 is not under operation limitation.

In this case, in the processing of the area change possibility judging section 150, it is determined in the step S1501 in FIG. 6 that the hydraulic excavator M1 is in operation (YES) and it is determined in the step S1503 that the hydraulic excavator M1 is not under operation limitation (NO). Then, it is determined in the step S1504 that the boundary of the requested work area is widened relative to the present work area (YES), and it is judged that change of the work area is possible (step S1502). This can change the work area while preventing sudden acceleration of the operation of the hydraulic excavator M1 due to change of the work area A1, i.e., sudden change in the operation of the hydraulic excavator M1 due to sudden disappearance of satisfaction of the condition of the operation limitation.

Effects in the present embodiment configured as above will be described.

In the prior art, although consideration is made about prevention of interference with an environmental object when a single work machine operates, consideration needs to be further made about the case in which an environmental object that is a subject of prevention of interference moves, i.e., prevention of interference between plural work machines, because it is also quite likely that plural work machines simultaneously carry out work in a working site.

In contrast, in the present embodiment, in the hydraulic excavator M1 including the work device 15 mounted on the machine main body (the upper swing structure 10 and the lower track structure 9), the plural actuators (for example, the boom cylinder 5, the arm cylinder 6, the bucket cylinder 7, the swing hydraulic motor 4, and the traveling hydraulic motors 3 (3*b*)) that drive the machine main body and the work device 15, the positioning devices 18*a* and 18*b* that acquire location information that is information relating to the location of the machine main body, the inertial measurement devices 13*a* to 13*c* that acquire posture information that is information relating to the posture of the work device, and the controller 100 that limits operation of at least one of the plural actuators on the basis of a work area that is an area in which movement of the machine main body and the work device 15 is permitted, the location information acquired in the positioning devices 18*a* and 18*b*, and the posture information acquired in the inertial measurement devices 13*a* to 13*c*, the controller 100 is configured to, in a case that a change instruction to instruct to change the work area to a requested work area is input, judge whether or not change of the work area to the requested work area is possible on the basis of the work area, the location information of the machine main body, and the posture information of the work device, and overwrite the work area with the requested work area to change the work area in an only case that it is judged that change is possible. Therefore, interference between plural work machines can be suppressed.

Figure 10:
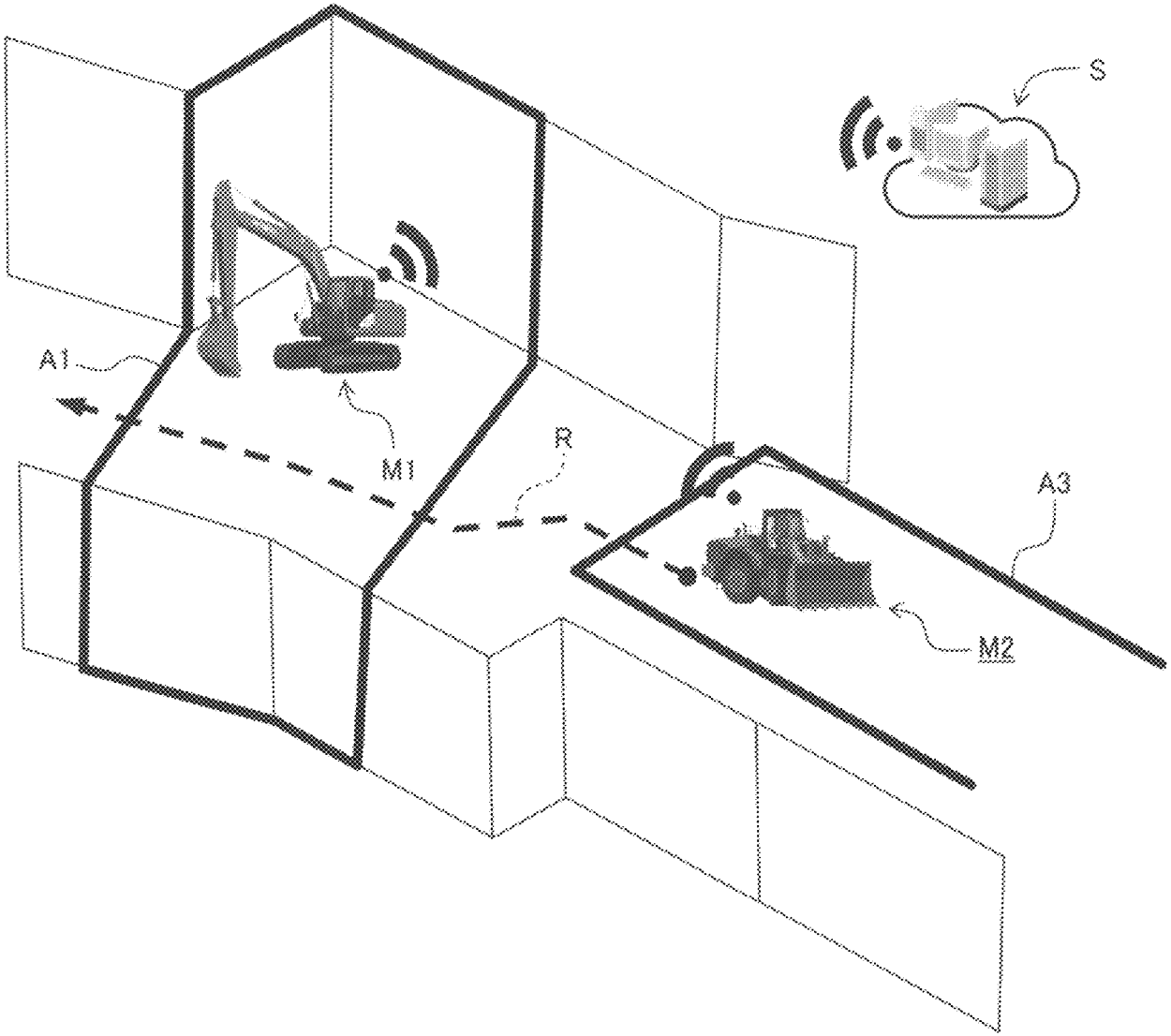
FIG. 10 is a diagram illustrating one example of a situation of a work site.

For example, in a situation in which plural construction machines operate at the same site as illustrated in FIG. 10, a method is conceivable in which a work area is set for each construction machine and control is carried out in such a manner that each construction machine does not deviate from the work area. FIG. 10 is a diagram illustrating one example of the situation of the work site. In FIG. 10, the case in which plural construction machines M1 and M2 are operating and respective work areas A1 and A3 are set is exemplified. The case in which a management control system S is disposed at the work site is exemplified.

In the situation like that illustrated in FIG. 10, in the case in which the prior art is applied, there is a possibility of occurrence of interference between the construction machines if the work areas overlap with each other. Moreover, in a situation in which the other construction machine M2 travels on a route R with respect to the work area A1 of the one construction machine M1, when the case in which a protective area is set and canceled according to button operation in the management control system and an in-machine communication terminal device is assumed, a problem that the other construction machine M2 cannot travel on the route R until the work area A1 of the one construction machine M1 is discarded is caused. Furthermore, in the case of canceling the work area A1 of the construction machine M1, the operator needs to instruct to cancel by button operation and the construction machine M1 needs to be evacuated. Thus, there is a possibility that work of the construction machine M2 is delayed.

In contrast, in the present embodiment, interference between plural work machines can be suppressed. In addition, lowering of the work efficiency can be suppressed.

Features of the above-described embodiment will be described below.

(1) In the above-described embodiment, in a work machine (for example, the hydraulic excavator M1) including the work device 15 mounted on a machine main body (for example, the upper swing structure 10 and the lower track structure 9), plural actuators (for example, the boom cylinder 5, the arm cylinder 6, the bucket cylinder 7, the swing hydraulic motor 4, and the traveling hydraulic motors 3 (3*b*)) that drive the machine main body and the work device, a location information acquiring device (for example, the positioning devices 18*a* and 18*b*) that acquires location information that is information relating to the location of the machine main body, a posture information acquiring device (for example, the inertial measurement devices 13*a* to 13*c*) that acquires posture information that is information relating to the posture of the work device, and the controller 100 that limits operation of at least one of the plural actuators on the basis of the work area A1 that is an area in which movement of the machine main body and the work device is permitted, the location information acquired in the location information acquiring device, and the posture information acquired in the posture information acquiring device, the controller is configured to, in a case that a change instruction to instruct to change the work area to a requested work area is input, judge whether or not change of the work area to the requested work area is possible on the basis of the work area, the location information of the machine main body, and the posture information of the work device, and overwrite the work area with the requested work area to change the work area in an only case that it is judged that change is possible.

This can suppress interference between plural work machines.

(2) Further, in the above-described embodiment, in the work machine (for example, the hydraulic excavator M1) of (1), the change instruction of the work area is generated at the external of the work machine in movement of another work machine (for example, the hydraulic excavator M1) at a working site and is input to the controller through a communication device disposed in the work machine.

(3) Moreover, in the above-described embodiment, in the work machine (for example, the hydraulic excavator M1) of (1), the controller 100 is configured to acquire an operation state of the work machine and determine whether the work machine is in operation, and judge that change of the work area is possible in a case of determining that the work machine is not in operation.

(4) Moreover, in the above-described embodiment, in the work machine (for example, the hydraulic excavator M1) of (3), the controller 100 is configured to determine whether operation of at least one of the plural actuators (for example, the boom cylinder 5, the arm cylinder 6, the bucket cylinder 7, the swing hydraulic motor 4, and the traveling hydraulic motors 3 (3*b*)) is being limited in a case of determining that the work machine is in operation, and judge that change of the work area is impossible in a case of determining that operation is being limited.

(5) Furthermore, in the above-described embodiment, in the work machine (for example, the hydraulic excavator M1) of (4), the controller 100 is configured to determine whether a boundary of the requested work area is remoter from the machine main body or the work device than a boundary of the work area in a case of determining that operation of at least one of the plural actuators (for example, the boom cylinder 5, the arm cylinder 6, the bucket cylinder 7, the swing hydraulic motor 4, and the traveling hydraulic motors 3 (3*b*)) is not being limited, and judge that change of the work area is possible in a case of determining that the boundary of the requested work area is remoter.

<Additional Notes>

The present invention is not limited to the above-described embodiment and various modification examples and combinations in such a range as not to depart from the gist thereof are included. Further, the present invention is not limited to what includes all configurations explained in the above-described embodiment, and what is obtained by deleting part of the configurations is also included. Moreover, regarding the above-described respective configurations, functions, and so forth, part or all of them may be implemented through being designed with an integrated circuit, or the like, for example. In addition, the above-described respective configurations, functions, and so forth may be implemented by software through interpretation and execution of a program that implements the respective functions by a processor.

Moreover, in the present embodiment, the configuration in which the controller 100 is mounted in the hydraulic excavator M1 has been described. However, for example, the controller 100 may be disposed separately from the hydraulic excavator M1 and be configured as a control system for the hydraulic excavator (construction machine) M1 that enables remote operation of the hydraulic excavator M1. Furthermore, only the area change possibility judging section 150 may be separated from the hydraulic excavator M1 and be configured to be disposed in the management control system S illustrated in FIG. 10, for example.

DESCRIPTION OF REFERENCE CHARACTERS

1*a*: Right operation lever device for traveling
1*b*: Left operation lever device for traveling
1*c*: Right operation lever device
1*d*: Left operation lever device
1*e*: Gate lock lever
2: Hydraulic pump device
3 (3*b*): Traveling hydraulic motor
4: Swing hydraulic motor
5: Boom cylinder
6: Arm cylinder
7: Bucket cylinder
8: Bucket (work equipment)
8*a*: Bucket link
9: Lower track structure
10: Upper swing structure
10*a*: Reference point
11: Boom
12: Arm
13*a* to 13*d*: Inertial measurement device (IMU)
14: Engine
15: Work device (front work implement)
15*a*: Reference point
16: Cab
18*a*, 18*b*: Positioning device
20: Control valve
100: Controller
110: Work area storing section
120: Operation limiting section
130: Main body control section
131: Map
132: Operator
140: Operation state acquiring section
150: Area change possibility judging section
500: Communication device
M1: Hydraulic excavator

The invention claimed is:

1. A work machine comprising:

a work device mounted on a machine main body;

a plurality of actuators that drive the machine main body and the work device;

a location information acquiring device that acquires location information that is information relating to a location of the machine main body;

a posture information acquiring device that acquires posture information that is information relating to posture of the work device; and a controller configured to limit operation of at least one of the plurality of actuators on a basis of a boundary of a work area that is an area in which movement of the machine main body and the work device is permitted, the location information acquired in the location information acquiring device, and the posture information acquired in the posture information acquiring device such that a movement velocity of the machine main body, an extension velocity of the work device, or a swing velocity of the work device becomes lower as the distance between the machine main body or the work device and the boundary of the work area becomes closer, wherein the controller is configured to, in a case that a change instruction that instructs widen or narrow the boundary of the work area to a boundary of a requested work area is input, judge whether widening or narrowing of the boundary of the work area to the boundary of the requested work area is possible on a basis of the boundary of the work area, the boundary of the requested work area, the location information of the machine main body, and the posture information of the work device, and overwrite the boundary of the work area with the boundary of the requested work area to widen or narrow the boundary of the work area only in a case that it is judged that widening or narrowing is possible, and wherein the controller is configured to determine whether the work machine is in operation based on the location information of the machine main body and the posture information of the work device, and judge that widening or narrowing of the boundary of the work area is possible in a case of determining that the work machine is not in operation.

2. The work machine according to claim 1, wherein the change instruction of the boundary of the work area is generated at external of the work machine in movement of another work machine at a working site and is input to the controller through a communication device disposed in the work machine.

3. The work machine according to claim 1, wherein the controller is configured to determine whether operation of at least one of the plurality of actuators is being limited in a case of determining that the work machine is in operation, and judge that widening or narrowing of the boundary of the work area is impossible in a case of determining that operation is being limited.

4. The work machine according to claim 3, wherein the controller is configured to determine whether the boundary of the requested work area is remoter from the machine main body or the work device than the boundary of the work area in a case of determining that operation of at least one of the plurality of actuators is not being limited, and judge that widening of the boundary of the work area is possible in a case of determining that the boundary of the requested work area is remoter.

* * * * *